US010011286B2

(12) United States Patent
Hirata et al.

(10) Patent No.: US 10,011,286 B2
(45) Date of Patent: Jul. 3, 2018

(54) FRONT DOOR FOR RAILCAR

(71) Applicant: KAWASAKI JUKOGYO KABUSHIKI KAISHA, Hyogo (JP)

(72) Inventors: Hiroyuki Hirata, Kobe (JP); Hitoshi Nagahara, Kobe (JP); Naotake Honda, Kobe (JP); Toshiyuki Hirashima, Kobe (JP)

(73) Assignee: KAWASAKI JUKOGYO KABUSHIKI KAISHA, Hyogo (JP)

( * ) Notice: Subject to any disclaimer, the term of this patent is extended or adjusted under 35 U.S.C. 154(b) by 245 days.

(21) Appl. No.: 14/979,824

(22) Filed: Dec. 28, 2015

(65) Prior Publication Data

US 2017/0183018 A1 Jun. 29, 2017

(51) Int. Cl.
*B61D 19/02* (2006.01)

(52) U.S. Cl.
CPC ..... *B61D 19/02* (2013.01)

(58) Field of Classification Search
CPC ..... B61D 19/00; B61D 19/02; B61D 19/023; B61D 19/026
See application file for complete search history.

(56) References Cited

U.S. PATENT DOCUMENTS 2,056,232 A * 10/1936 Blomberg ..... B61D 17/06 105/397
4,216,725 A * 8/1980 Hallam ..... B61D 17/20 105/348

* cited by examiner

*Primary Examiner* — Robert J McCarry, Jr.
(74) *Attorney, Agent, or Firm* — Studebaker & Brackett PC

(57) ABSTRACT

The present disclosure relates to a front door to be provided on an end panel of an end portion of a railcar. The front door includes a hinge provided at a first vertical side portion on the front door, the hinge supporting the front door rotatably toward the car interior side, a lock mechanism provided at a second vertical side portion on the front door, the lock mechanism locking the front door, and an emergency support mechanism that holds the front door on the end panel upon collision of an object with the front door in a locked state.

4 Claims, 10 Drawing Sheets

FRONT DOOR FOR RAILCAR

TECHNICAL FIELD

The present disclosure relates to a front door for a railcar.

BACKGROUND

Railcars sometimes include a front door provided on an end panel of the car. There are plural types in the front door including an opening out type, an opening in type, a sliding type, a plug type, and so on. Such railcars need to meet a specification that even in a case where an object of a specified weight collides with the front door at a specified speed from the front of the front door, the front door can survive against the collision and the object does not come into the car interior.

SUMMARY

Particularly in the opening in type front door, the front door is supported on the end panel of the car only by a hinge provided at one vertical side on the front door and a latch provided at the other vertical side to lock the front door to the end panel. Consequently, this type of the front door is sometimes disadvantageous in terms of strength upon collision of the object from the front side of the front door.

An aim of the present disclosure is to provide a front door for a railcar capable of, upon collision of an object from the front side of the front door, preventing the object from coming into the car interior.

In order to accomplish the object, there is provided a front door for a railcar according to one aspect of this disclosure installed on an end panel of a railcar, the front door comprising:

a hinge supporting the front door rotatably toward a car interior side; the hinge being provided at a first vertical side portion on the front door, a lock mechanism provided at a second vertical side portion on the front door opposite to the first vertical side portion, and locking the front door;

a door extension portion extending from the first vertical side portion in a car width direction, and including an opening portion along an up and down direction; and a stopper fixed on a car body side, and extending in the up and down direction in response to the door extension portion, wherein the stopper includes a protruding portion extending in a car longitudinal direction and extending through the opening portion of the door extension portion.

According to the above configuration, in the front door for the railcar, a colliding object is prevented from coming into the car interior.

DETAILED DESCRIPTION OF THE PREFERRED EMBODIMENTS

Figure 1:
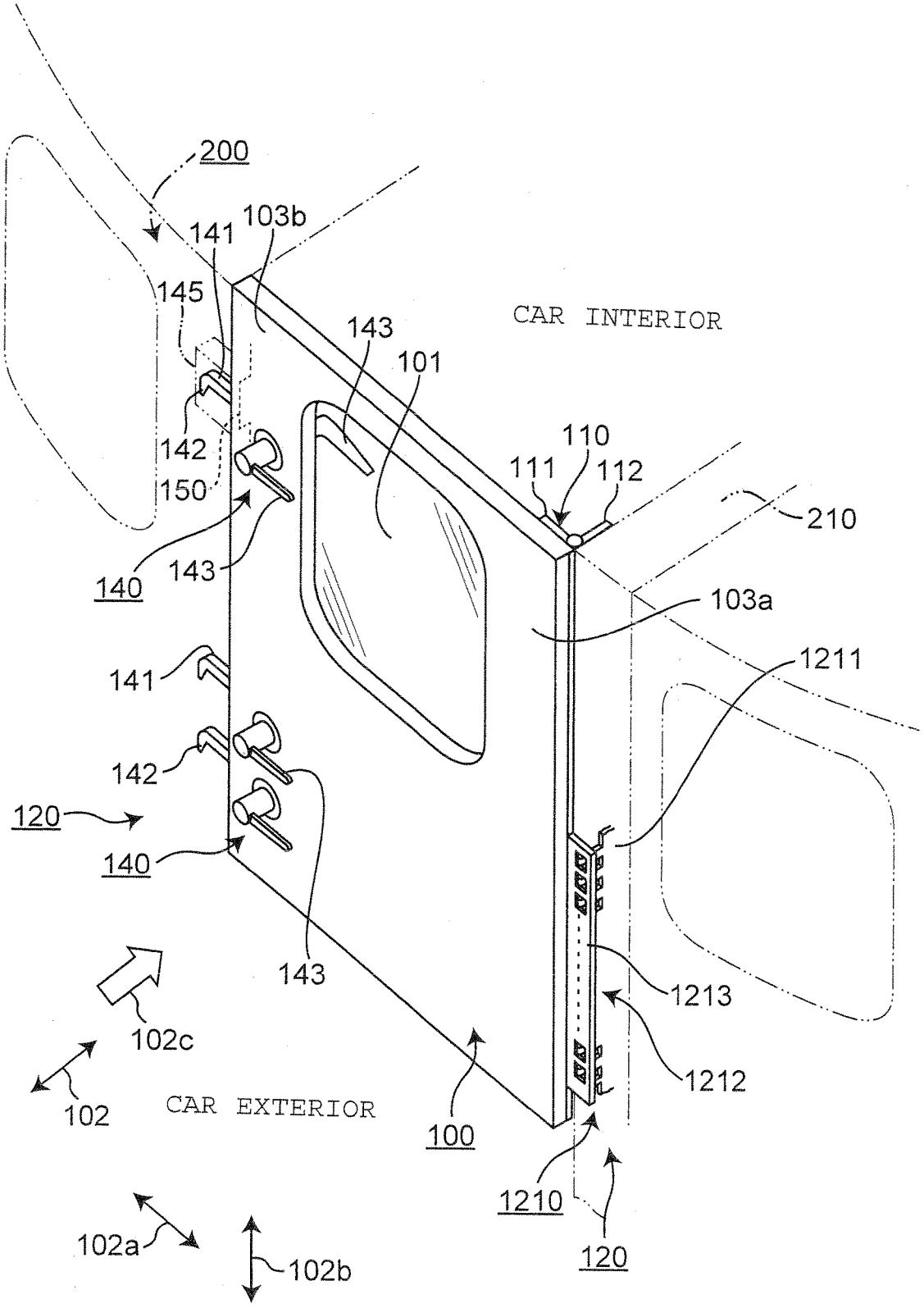
FIG. 1 is a perspective view showing a schematic structure of a front door for a railcar in an embodiment, the front door being positioned on an end panel of the railcar.

Hereinafter, a front door for a railcar serving as an embodiment will be described with reference to the drawings. It should be noted that in the figures, the same or similar constituent parts will be given the same reference signs. In order to avoid unnecessary wordiness in the following description and to facilitate understanding of those skilled in the art, detailed description of the already-well-known matters and repetitive description for the substantially identical configurations may sometimes be omitted. Contents of the following description and the attached drawings do not intend to limit the subject matters described in the claims.

The front door for the railcar of the present embodiment needs to meet a specification that even in a case where an object of a specified weight collides with the front door from the front side of the front door at a specified speed, the front door can survive against the collision and the object does not come into the car interior.

Firstly, measures, which have been already considered, for preventing an object colliding from the front side of a front door from coming into the car interior will be described.

As already described, the front door for the railcar is supported on the end panel of the car by the hinge and the latch. Thus, one way to absorb collision energy of the object at the parts of the hinge and the latch is to increase strength of the hinge and the latch themselves. However, due to space constraints, the hinge is not easily enlarged. By increasing the number of attachment screws for the hinge, attachment strength of the hinge is enhanced. However, since a sectional area of a hinge plate is reduced due to the increment of the number of the attachment screws, this measure does not easily lead to improvement in the strength of the hinge itself. Further, the addition of the number of the screws increases working processes and cost.

In another measure for surviving the front door and preventing the object from coming into the car interior, absorbing the collision energy by the entire front door is considered. However, the latch is disengaged by deformation of the front door and then the front door is opened. Further there is a measure of absorbing the collision energy by providing an aluminum honeycomb or the like serving as a collision energy absorber on a front surface of the front door. However, this measure has a limit in terms of a usable space and poor cost benefit ratio.

From the above considerations, a measure for preventing the colliding object from coming into the car interior is required, wherein the measure has a structure which is the one as simple as possible to suppress a cost increase, and even in a case where the front door is deformed the latch is not disengaged.

The front door for the railcar of the present embodiment responds to such requirement.

Hereinafter, the front door for the railcar to which the above measure for preventing the object from coming into the car interior is applied will be described in further detail.

First Embodiment

FIG. 1 shows a schematic structure of a front door for a railcar (hereinafter, simply referred to as the "front door") 100 in the present embodiment. The front door 100 is provided on an end panel 200 of the railcar, and utilized for an emergency exit or for a gateway between the cars. The front door 100 of the present embodiment has a window 101 in an upper part thereof. However, the window 101 is not necessarily provided. A collision condition is as follows: a specified object collides with a place on the front door other than the window in a colliding direction 102*c* orthogonal to the front door 100 from a front side of the front door 100.

As the schematic structure of the front door 100, for example, a frame body shaping external form of the door is formed by press working, and a honeycomb member or a foamed resin or the like serving as a panel core is attached to the frame body. The front door 100 has a hinge 110, an emergency support mechanism 120, and lock mechanisms 140 as basic constituent elements. The hinge 110 and part of the emergency support mechanism 120 are mounted at a first vertical side portion 103*a* corresponding to one of left and right vertical side portions, and the lock mechanisms 140 are installed at a second vertical side portion 103*b* corresponding to the other of the above left and right vertical side portions. These constituent elements will be described in detail below.

Figure 4:
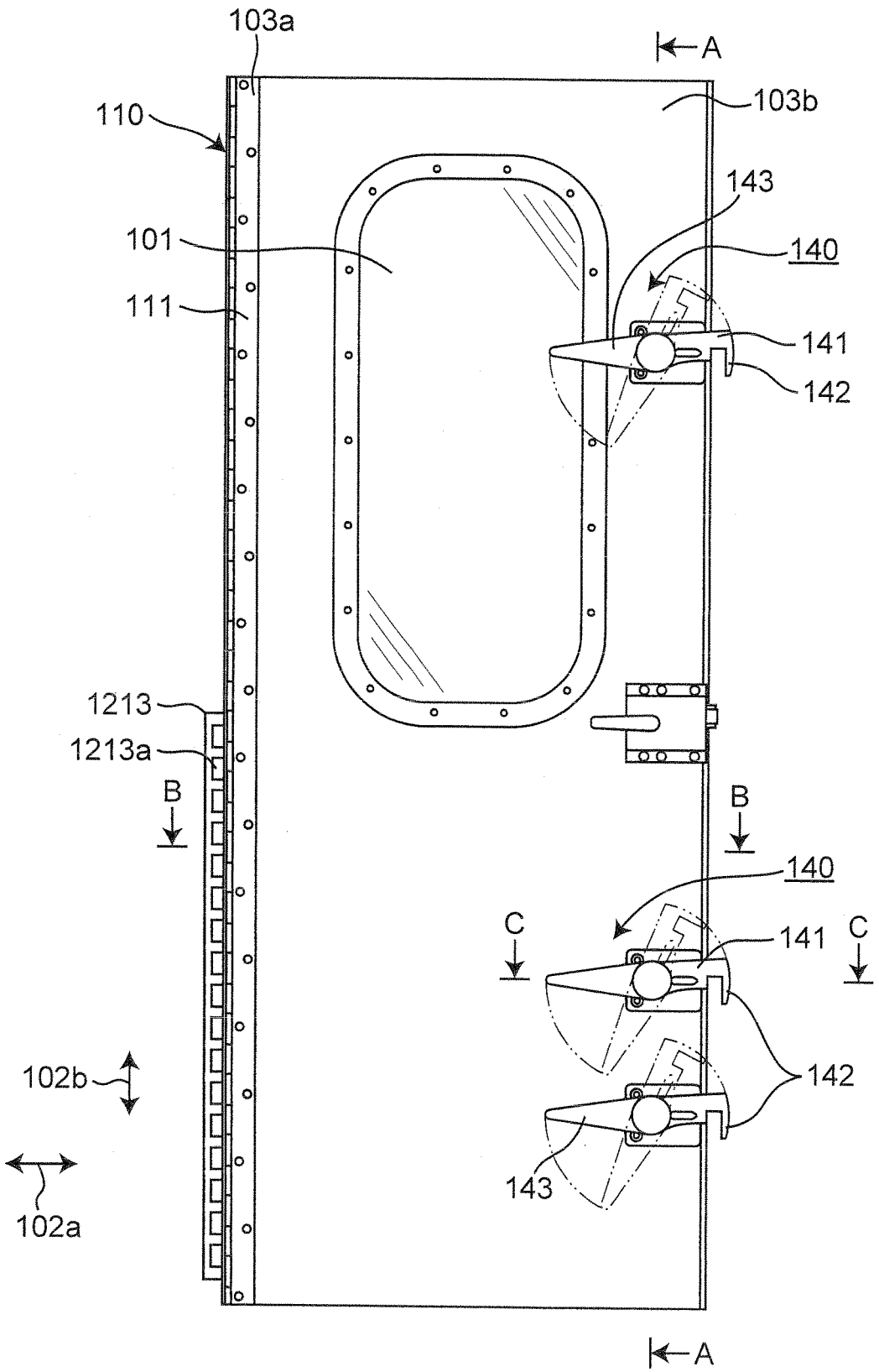
FIG. 4 is a front view in which the front door shown in FIG. 1 is seen from the car interior.
Figure 7:
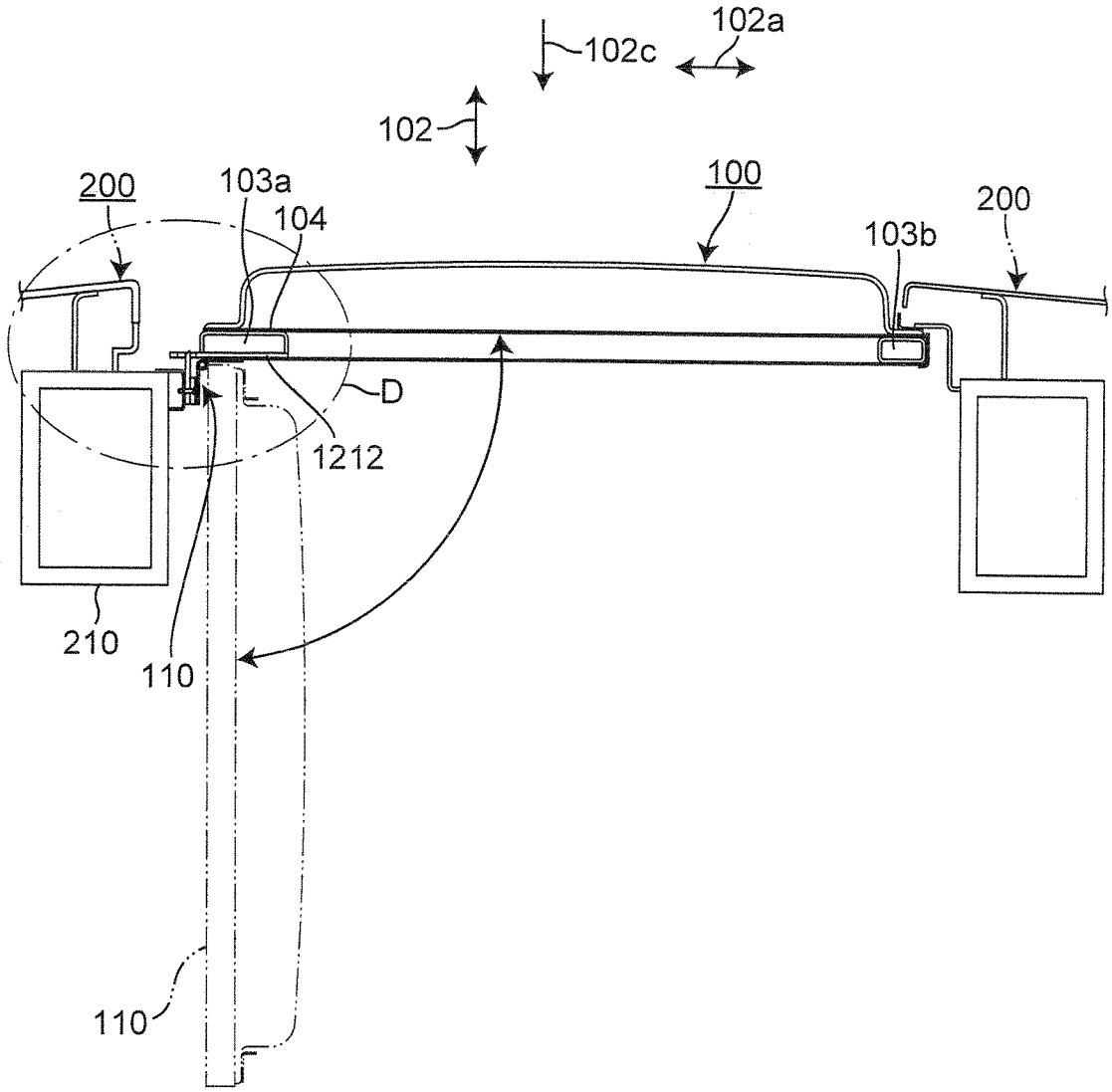
FIG. 7 is a cross-sectional view taken along part B-B shown in FIG. 4.

The hinge 110 is a member connecting the first vertical side portion 103*a* on the front door 100 with the end panel 200 as shown in FIGS. 1, 4, and 7, and pivotably supporting the front door 100 with respect to the end panel 200 such that the front door 100 is rotated toward the car interior side as shown in FIGS. 1 and 7. It should be noted that the end panel 200 is part of a structural member forming a car body. One plate 111 of the hinge 110 extends along the first vertical side portion 103*a* over the entire length of the portion in an up and down direction (a longitudinal direction of the front door 100) 102*b* as shown in FIGS. 1 and 4. The plate 111 is screwed onto a structural member (details will be described later) of the front door 100 at proper intervals over the entire length thereof. A way for connecting the other plate 112 of the hinge 110 with the end panel 200 is also the same.

The emergency support mechanism 120 of the front door 100 eliminates a need for giving the hinge 110 increased strength for satisfying the specification mentioned above. The hinge 100 just has to have a strength required for a usual open/close operation of the front door 100. Consequently, the front door 100 eliminates an increment in the number of attachment screws of the hinge 110. Therefore, the front door 100 does not lead to increase costs due to an increment in the number of parts and increasing of working processes in accordance with the increment of the parts.

Next, the emergency support mechanism 120 will be described.

The emergency support mechanism 120 is a mechanism for holding the front door 100 on the end panel 200 even in a case where the object collides from the front side of the front door 100 in a state where the front door 100 is locked to the end panel 200. This emergency support mechanism 120 includes a support member 1210 provided in response to the hinge 110. The emergency support mechanism 120 may further be provided with engagement maintaining members 142 in the lock mechanisms 140, and cut-away portions 150 at positions in response to the lock mechanisms 140 in the front door 100.

The support member 1210 is a member supporting the front door 100 on the end panel 200 instead of the hinge 110 even when the object collides from the front side of the front door 100 and the hinge 110 is remarkably deformed and then ruptured. The support member 1210 has a stopper 1211, and a tabular member 1212 serving as one of the structural member of the front door 100.

Figure 2:
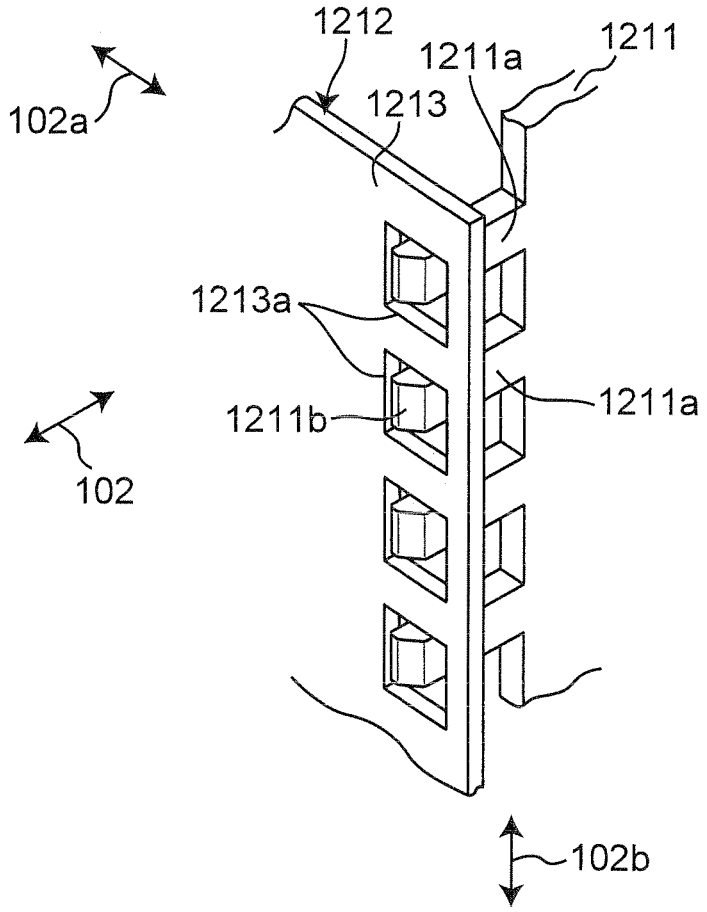
FIG. 2 is a perspective view showing a schematic structure of a support member included in the front door shown in FIG. 1.
Figure 5:
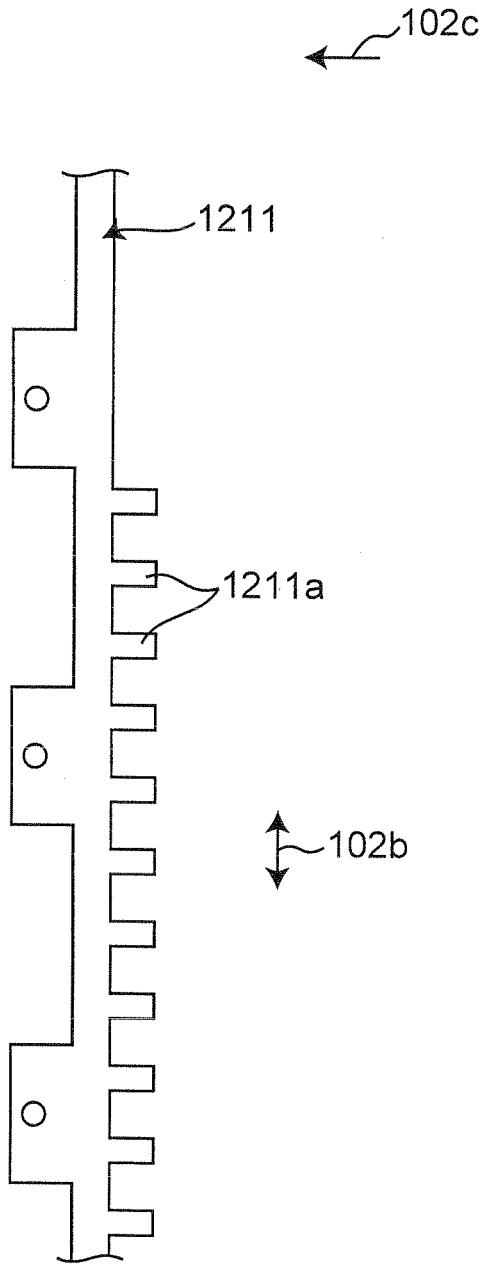
FIG. 5 is a front view of a stopper included in the support member shown in FIGS. 2 and 3.
Figure 6:
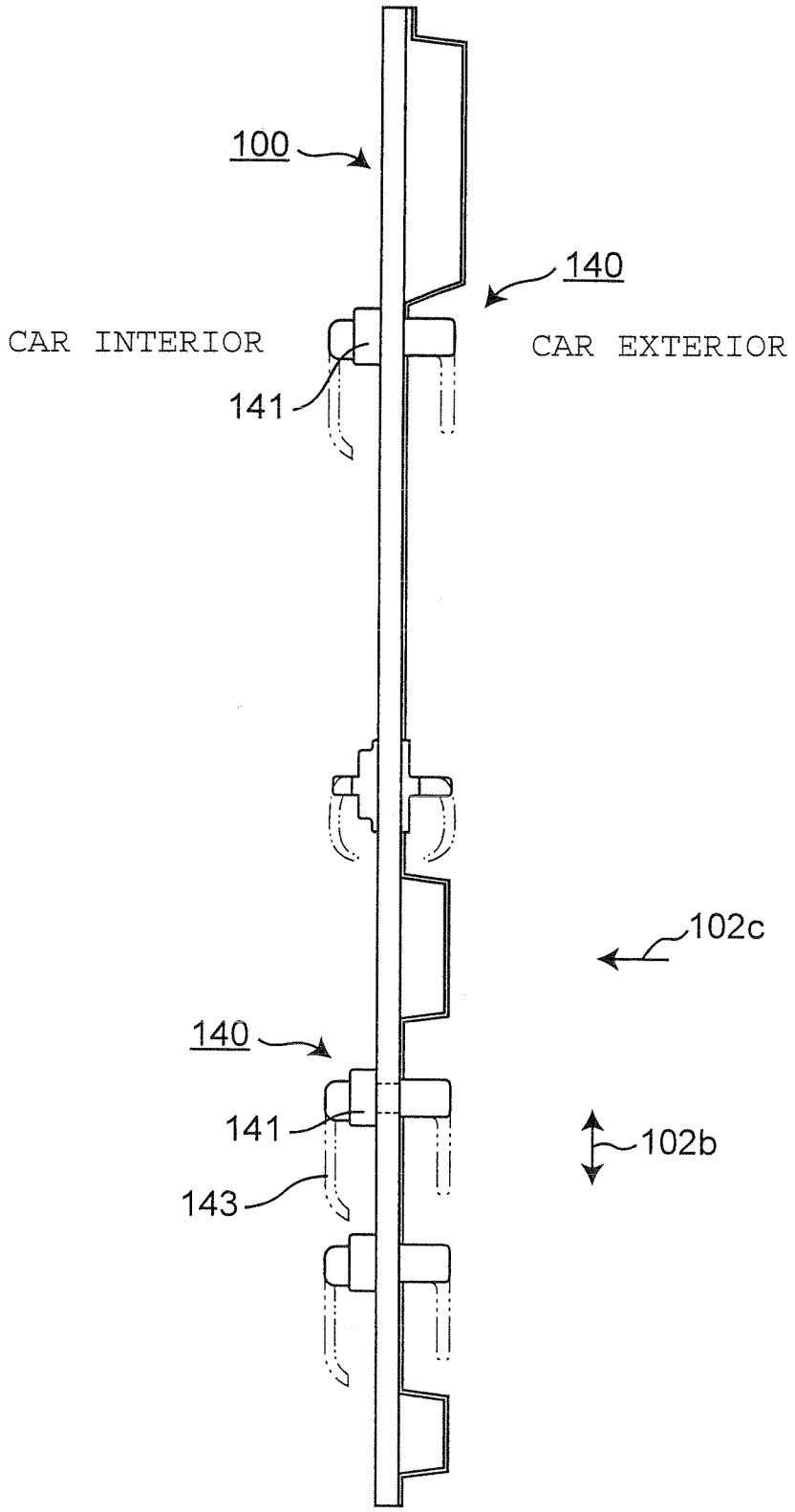
FIG. 6 is a cross-sectional view taken along part A-A shown in FIG. 4.

The stopper 1211 is a strip-shaped plate with a plurality of projections 1211*a*. The projections 1211*a* corresponding to one example of a protruding portion respectively extend in a car longitudinal direction 102 and are arranged in the up and down direction 102*b* as shown in FIGS. 2 and 5. The stopper 1211 is fixed to a structural member 210 (FIG. 1) on the end panel 200 as shown in FIGS. 1 and 8.

Figure 8:
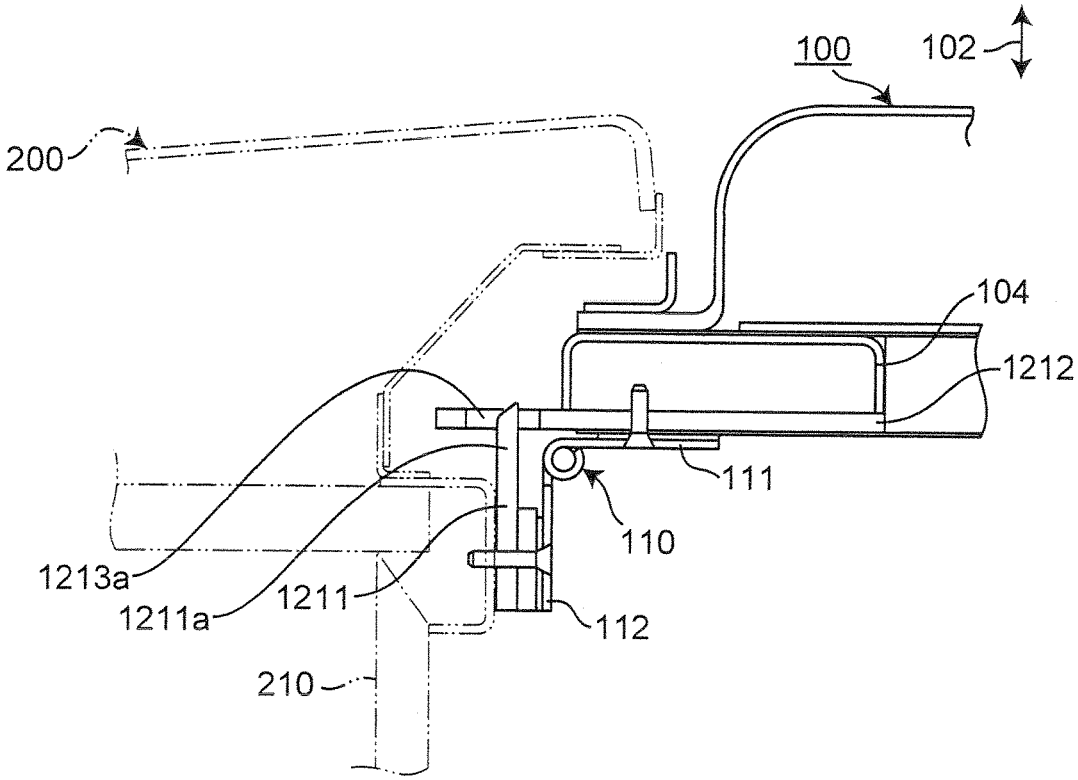
FIG. 8 is an enlarged view of part D shown in FIG. 7.

As shown in FIG. 8, the stopper 1211 attached to the structural member 210 on the end panel 200 also serves as part of an attachment base for the plate 112 of the hinge 110.

As shown in FIGS. 4, 7, and 8, the tabular member 1212 forms part of the structural member of the front door 100. That is, a channel steel 104 forming a frame body of the front door 100 is provided at the first vertical side portion 103*a* on the front door 100. The tabular member 1212 extends along the channel steel 104 over the entire length of the channel steel, and is fixed to the channel steel 104 by welding so as to close a groove of the channel steel 104. Therefore, the tabular member 1212 is integrated with the channel steel 104 serving as the structural member of the front door 100, thereby forming the structural member of the front door 100.

The tabular member 1212 forming the structural member of the front door 100 also has a function as an attachment base for the plate 111 of the hinge 110 as shown in FIGS. 4 and 8.

Allowing the tabular member 1212 to serve as the attachment base for the hinge 110 reduces the number of pieces and associated manufactured steps, so that cost can be reduced. Further, the tabular member 1212 is part of the structural member of the front door 100 and hence is strong. Thus, even in a case where the object collides with the front door 100 from the front side of the front door 100, the hinge 110 does not drop off the front door 100 on its own unless the front door 100 is broken down. Therefore, the tabular member 1212 also functioning as the attachment base for the hinge 110 also contributes to an effect of preventing the colliding object from coming into the car interior.

Further, as shown in FIGS. 4 and 7, the tabular member 1212 has a door extension portion 1213 (FIGS. 1, 2, and 4) extending in the car width direction 102*a* at a lower region where no window 101 is provided on the front door 100. Further, in the door extension portion 1213, the tabular member 1212 has a plurality of opening portions 1213*a* arranged along the up and down direction 102*b*.

It should be noted that the above lower region corresponds to a region from a substantially lower part of the front door 100 to a substantially center part in the up and down direction 102*b* of the front door 100.

Figure 3A:
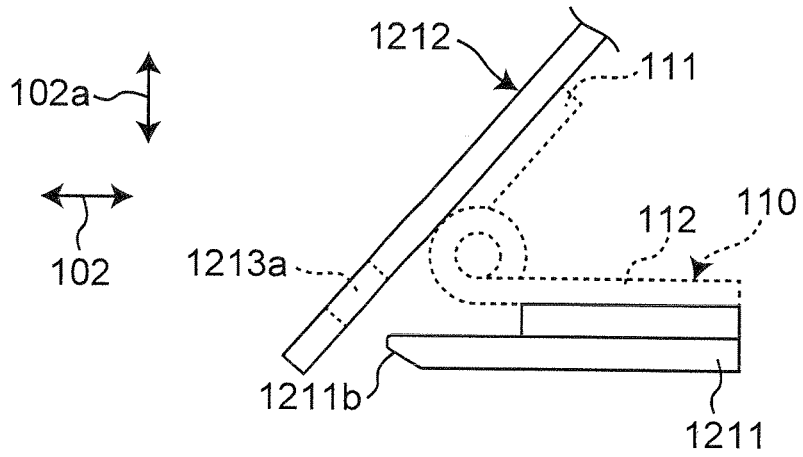
FIG. 3A is a plan view showing the schematic structure of the support member included in the front door shown in FIG. 1, the view showing a normal state.

In an usual open/close state of the front door 100 (hereinafter, simply referred to as the "normal state"), each of the opening portions 1213*a* is an opening into which each of the projections 1211*a* of the stopper 1211 described above simply penetrates, for example as shown in FIG. 2. That is, in the normal state, as shown in FIG. 3A, the opening portions 1213*a* and the projections 1211*a* are not brought into contact with or engaged with each other, so that a smooth open/close operation of the front door 100 is enabled.

It should be noted that in the present embodiment, in order to prevent interference between the opening portions 1213*a* and the projections 1211*a* at the time of open/close, each of the projections 1211*a* has a chamfer 1211*b* at a leading end part thereof, as shown in FIG. 2.

Meanwhile, as described in detail later, the projections 1211*a* are arranged while penetrating into the opening portions 1213*a*. Thus, at the time of collision of the object as defined in the above specification, the projections 1211*a* and the opening portions 1213*a* are engaged with each other.

As clear from the above description, the projections 1211*a* of the stopper 1211 and the opening portions 1213*a* of the tabular member 1212 are designed in such a manner that the number and arrangement of the projections 1211*a* correspond to those of the opening portions 1213*a*.

According to the front door 100 of the present embodiment, the following effect can be obtained.

Figure 3B:
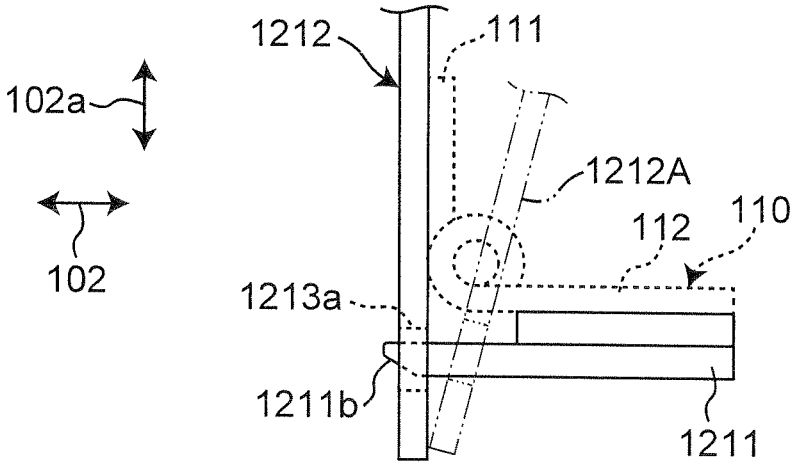
FIG. 3B is a plan view showing the schematic structure of the support member included in the front door shown in FIG. 1, the view showing a state where a hinge is ruptured.

In a case where the object collides from the front side of the front door 100 and then the hinge 110 is broken down, the projections 1211*a* and the opening portions 1213*a* are engaged with each other. Firstly, when the object collides with the front door 100 from the front side, a load toward the car interior side is applied to the front door 100. At that time, rotational displacement force about the hinge 110 is generated. In the case of greater load, the hinge 110 is deformed, and at the end, a main body part of the hinge 110 or a screw part fastening the hinge 110 and the structural member 210 is ruptured. Then, the tabular member 1212 is displaced to the car interior side together with the front door 100 as shown in FIG. 3B. It should be noted that in FIG. 3B, a tabular member 1212A shown by an imaginary line indicates a conceptual view of a case where the tabular member 1212 is displaced by the rupture of the hinge 110.

When the front door 100 is to be displaced toward the car interior side, the door extension portion 1213 is abutted with the structural member 210. Thus, the front door 100 is suppressed from moving toward the car interior side. Further, even when the front door 100 is to be displaced toward the car interior side, due to the projections 1211*a* arranged while penetrating into the opening portions 1213*a*, the projections 1211*a* and the opening portions 1213*a* are engaged with each other (FIG. 3B). Therefore, if the hinge 110 is raptured, engagement between the projections 1211*a* and the opening portions 1213*a* in the emergency support mechanism 120 for receiving an out-of-plane load causes the front door 100 to suppress from coming off the end panel 200 and moving to the car interior.

The stopper 1211 and the tabular member 1212 are plate members with a simple structure of only having the projections 1211*a* and the opening portions 1213*a*. Nevertheless as described above, this structure can have a large benefit of preventing the front door 100 from coming off the end panel 200 and preventing the object from coming into the car interior upon the collision of the object from the front side of the front door 100.

In the present embodiment, the opening portions 1213*a* in the tabular member 1212 of the front door 100 and the projections 1211*a* of the stopper 1211 installed on the end panel 200 may be replaced with each other. That is, the front door 100 can have any one of a plate member with the opening portions 1213*a* and a plate member with the projections 1211*a*.

In the present embodiment, the support member 1210 includes the stopper 1211 and the tabular member 1212. However, the support member is not limited to the plate member, and members to be used by those skilled in the art, for example, pins such as round bars can also be applied. These members may be manufactured by various methods such as casting, forging, and milling. Materials of these are not limited to metal and may be for example fiber-reinforced plastic materials.

In the present embodiment, the plurality of projections 1211*a* of the stopper 1211 and the plurality of opening portions 1213*a* of the tabular member 1212 are provided. However, the number of them is not limited to this embodiment and at least one projection and at least one opening portion are required.

Next, the lock mechanisms 140 will be described.

As shown in FIGS. 1 and 4, the lock mechanisms 140 are mechanisms provided in the second vertical side portion 103*b* opposite to the first vertical side portion 103*a* on the front door 100 and locking the front door 100. It should be noted that when the lock mechanisms 140 are unlocked, the front door 100 can be opened/closed by the hinge 110.

Figure 9:
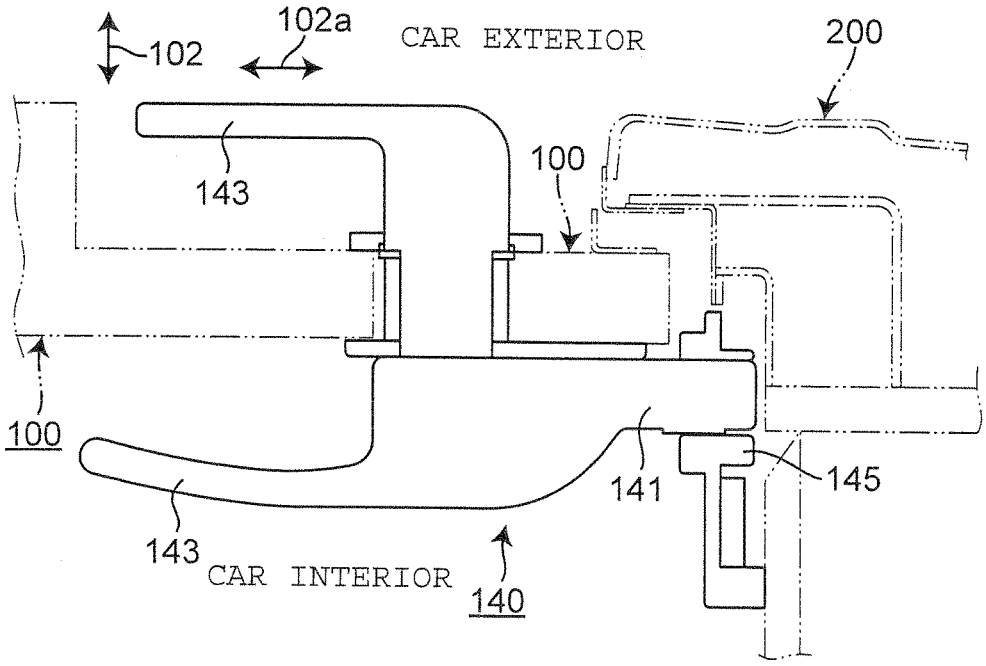
FIG. 9 is a cross-sectional view taken along part C-C shown in FIG. 4.
Figure 11:
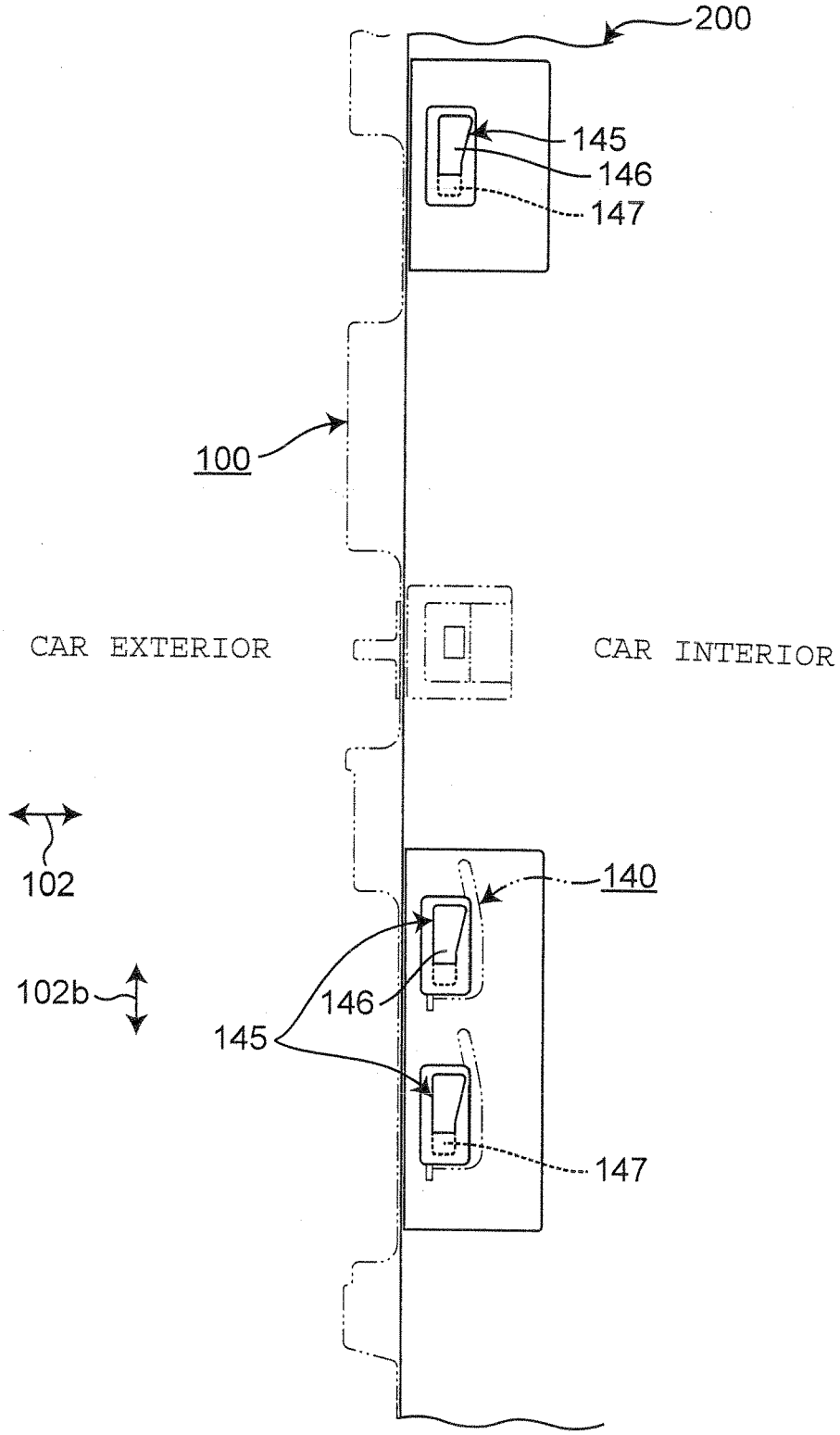
FIG. 11 is a view showing receiving members to be engaged with arm members included in the front door shown in FIG. 1.

Such lock mechanisms 140 have a configuration similar to a mechanism having a so-called cam latch handle and a receiver for the cam latch handle. Specifically, as shown in FIG. 9, each of the lock mechanisms 140 has an arm member 141 and a receiving member 145. The arm member 141 and the receiving member 145 form one set of lock mechanism 140. The arm member 141 is rotated about a rotation shaft provided in the front door 100 and engaged with the receiving member 145 on the car body side. As shown in FIG. 11, the receiving member 145 has a recessed portion 146 receiving the arm member 141 and is engaged with the arm member 141. Further, as shown in FIG. 11, the recessed portion 146 has a pocket portion 147 into which the engagement maintaining member 142 explained below is fitted.

In the present embodiment, three sets of lock mechanisms 140 are provided. As shown in FIG. 4, the front door 100 has the arm members 141 at three in the second vertical side portion 103*b*. Similarly, the receiving members 145 are installed at three positions in the structural member in response to the arm members 141. However, the front door 100 may have any one of the arm members 141 and the receiving members 145, and the other one of the arm members 141 and the receiving members 145 may be installed in the structural member. The number of the installed lock mechanisms 140 is not limited to three and only required to be two or more.

Further, each of the arm members 141 has the engagement maintaining member 142 that prevents disengagement between the receiving member 145 and the arm member 141, that is, unlocking upon the collision of the object as defined in the above specification. As shown in FIG. 4, a substantially L-shape member at a leading end of the arm member 141 corresponds to this engagement maintaining member 142.

Each of the lock mechanisms 140 formed as above has the following functions.

The arm member 141 includes a handle 143, and as shown in FIG. 4, is installed to the front door 100 so as to swing between a lock position shown by a solid line and an unlock position shown by the imaginary line by the handle 143. The front door 100 is closed and then by swinging the arm member 141 to the lock position, the arm member 141 and the receiving member 145 are engaged with each other, so that the front door 100 is locked. Meanwhile, by swinging the arm member 141 to the unlock position, the arm member 141 and the receiving member 145 are brought into a disengaged state, so that the front door 100 is unlocked and then can be opened. It should be noted that when the arm member 141 is placed at the unlock position, the arm member 141 is housed within the front door 100.

The engagement maintaining member 142 and the receiving member 145 respectively have inclined surfaces at engaging portions where both members are engaged with each other. A watertight gasket is provided at the circumference of the front door 100. Therefore, by swinging the arm member 141 from the unlock position to the lock position in a state where the arm member 141 and the receiving member 145 are engaged with each other, the inclined surfaces of them slide on each other, so that the front door 100 is moved in a direction in which the watertight gasket is compressed.

Such lock mechanism 140 shows the following effects.

For example, if an arm member is a simple straight member without having the L-shape engagement maintaining member 142 of the arm member 141 at the leading end part thereof, and when the front door is deformed by the collision of the object, it would be considered that the arm member comes off the receiving member and then is disengaged.

On the other hand, in the present embodiment, the arm member 141 has the substantially L-shape engagement maintaining member 142 at the leading end part thereof. Therefore, in the locked state, the engagement maintaining member 142 comes into the pocket portion 147 (FIG. 11) in the receiving member 145. As a result, even in a case where the front door is deformed by the collision of the object, engagement between the engagement maintaining member 142 and the pocket portion 147 can be maintained. Thereby, the arm member 141 can be prevented from coming off the receiving member 145 and both the members can be prevented from being disengaged. Therefore, the front door 100 does not become to the unlocked state and the colliding object also does not come into the car interior.

Next, a further additional configuration to the front door 100 will be described.

In the present embodiment, the front door 100 can further adopt the following configuration.

In the above description, a case where the object collides with a main body part of the front door 100 is assumed. However, a case where the object directly collides with the part of the lock mechanisms 140 is also assumed. In order to deal with this case, it is also required to enhance rigidity of the lock mechanisms 140 themselves. Meanwhile, a measure that by intentionally weakening rigidity of the front door 100, part of the collision energy by the object is absorbed by deformation of the front door 100, so that impact force to the lock mechanisms 140 is weakened is considered.

Figure 10:
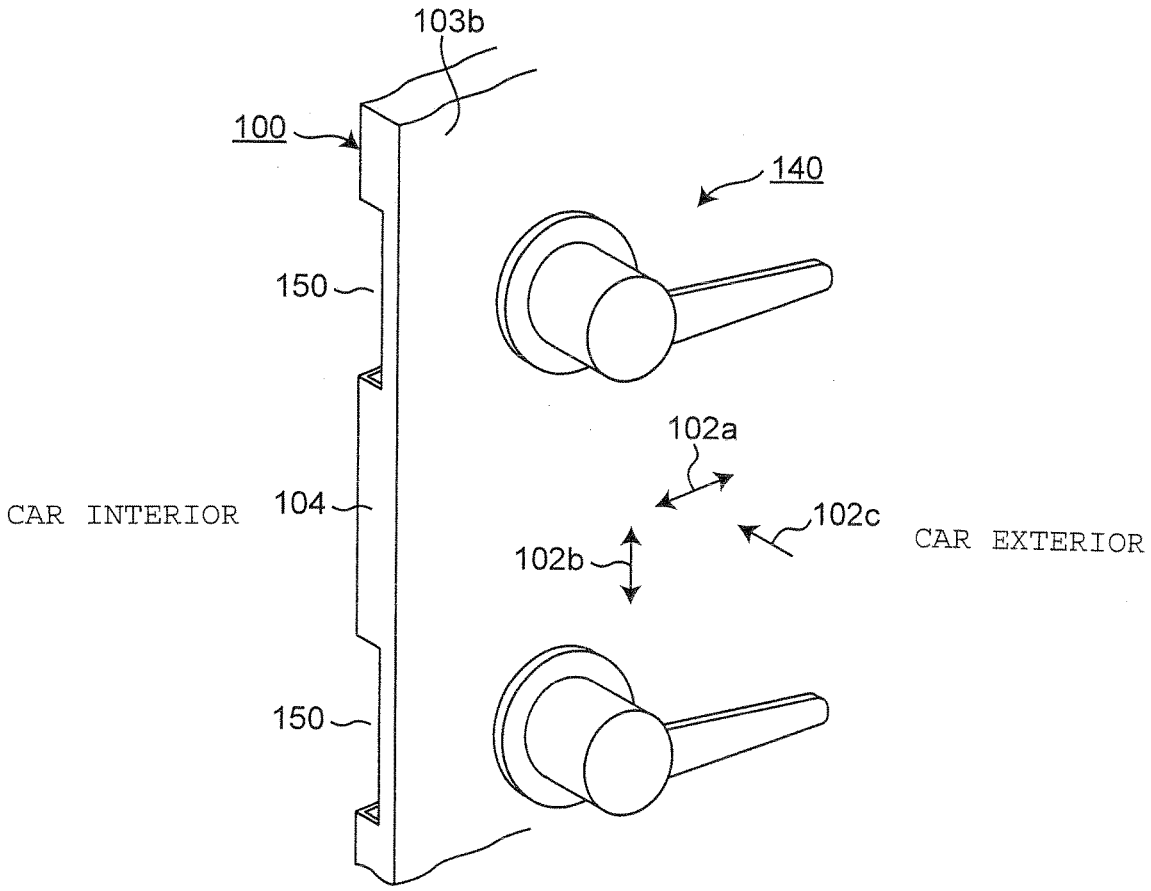
FIG. 10 is a perspective view schematically showing cut-away portions included in the front door shown in FIG. 1.

Specifically, for example as shown in FIG. 10, the cut-away portions 150 disposed at the car interior side of the front door 100 are provided along the second vertical side portion 103*b* on the front door 100. Such cut-away portions 150 prevent disengagement between the arm members 141 and the receiving members 145 upon the collision of the object. Also, the cut-away portions 150 are positioned in response to the lock mechanisms 140 and are arranged at three positions in the present embodiment.

Providing the cut-away portions 150 allows to absorb impact force by deforming the part of the cut-away portions 150 with a low-strength if the object directly collides with the lock mechanisms 140. The colliding object can be prevented from coming into the car interior due to a synergistic effect of having the engagement maintaining members 142 in the arm members 141 and providing the cut-away portions 150.

As described above, according to the front door 100 in the present embodiment, in virtue of providing the emergency support mechanism 120, even in a case where the object collides with the front door 100 from the front side of the front door 100, the front door 100 is not unlocked, so that the colliding object can be prevented from coming into the car interior. Specifically, the projections 1211*a* of the stopper 1211 and the opening portions 1213*a* of the tabular member 1212, both of which form the emergency support mechanism 120, are engaged with each other. Therefore, the front door 100 is prevented from dropping off the end panel 200. The engagement maintaining members 142 of the arm members 141 and the receiving members 145, both of which form the emergency support mechanism 120, are engaged with each other. Thus, the object colliding with the front door 100 does not come into the car interior.

By virtue of providing the cut-away portions 150 as the emergency support mechanism 120, even in a case where the object directly collides with the lock mechanisms 140, the cut-away portions 150 with the low-strength of the front door 100 are forcibly broken down, so that the impact associated with the collision of the object can be absorbed. Therefore, by a synergistic effect created by the stopper 1211, the tabular member 1212, and the engagement maintaining members 142 described above, the front door 100 is held on the end panel 200, so that the colliding object does not come into the car interior.

As described above, in the present embodiment, in spite that the emergency support mechanism 120 has a simple configuration, it is also one of the effects that the emergency support mechanism 120 can generate a large effect that the colliding object is prevented from coming into the car interior.

The front door for the railcar of the present embodiment can also adopt the following aspects.

The front door for the railcar is a front door to be provided on an end panel of an end section of a railcar. This front door may include a hinge, a lock mechanism, a door extension portion, and a stopper. The hinge may support the front door rotatably toward the car interior side and may be provided at a first vertical side portion on the front door. The lock mechanism may be provided at a second vertical side portion on the front door opposite to the first vertical side portion, and may lock the front door. The door extension portion may extend from the first vertical side portion in the car width direction, and may have an opening portion along the up and down direction. The stopper may be fixed on the car body side, and may extend in the up and down direction in response to the door extension portion. The stopper may have a protruding portion extending in the car longitudinal direction and extending through the opening portion of the door extension portion.

According to the above configuration, the front door for the railcar has the door extension portion and the stopper, and the protruding portion of the stopper extends through the opening portion provided in the door extension portion. Thereby, even in a case where the object collides with the front door in the locked state from the front side of the front door, the front door is held on the end panel. Therefore, the colliding object is prevented from coming into the car interior.

In the above aspect, the lock mechanism may have an arm member to be rotated about a rotation shaft provided in the front door and engaged with a receiving member on the car body side. Also, a leading end of the arm member to be engaged with the receiving member may be formed in a substantially L-shape.

By virtue of this configuration, even in a case where the front door is deformed by the collision of the object, engagement between the leading end of the arm member and the receiving member on the car body side is maintained. Therefore, the front door is not unlocked, so that the colliding object does not come into the car interior.

In the above aspect, a cut-away portion may further be provided on a side surface of the second vertical side portion on the front door at a position in response to the lock mechanism.

By virtue of this configuration, even in a case where the object directly collides with the lock mechanism and impact is added by any chance, the impact can be absorbed by deforming the part of the cut-away portion with the low-strength.

In the above aspect, the door extension portion may be provided from a substantially lower part to a substantially center part in the up and down direction of the front door.

By virtue of this configuration, the front door can be prevented from coming off the car body with a simple structure, and the object can be prevented from coming into the car interior upon the collision of the object from the front side.

The present disclosure sufficiently describes the preferred embodiment with reference to the attached drawings. However, various modifications and corrections are obvious for those skilled in this art. It should be understood that such modifications and corrections are included in the scope of the present disclosure unless the modifications and corrections are out of the scope specified by the attached claims.

The invention claimed is:

1. A front door provided on an end panel of a railcar, the front door comprising:

a hinge supporting the front door rotatably toward a car interior side; the hinge being provided at a first vertical side portion on the front door, a lock mechanism provided at a second vertical side portion on the front door opposite to the first vertical side portion, and locking the front door;

a door extension portion extending from the first vertical side portion in a car width direction, and including an opening portion along an up and down direction; and a stopper fixed on a car body side, and extending in the up and down direction in response to the door extension portion, wherein the stopper includes a protruding portion extending in a car longitudinal direction and extending through the opening portion of the door extension portion.

2. The front door according to claim 1, wherein the lock mechanism includes an arm member rotated about a rotation shaft provided in the front door and engaged with a receiving member on the car body side, and a leading end of the arm member to be engaged with the receiving member is formed in a substantially L-shape.

3. The front door according to claim 1, further comprising a cut-away portion formed on a side surface of the second vertical side portion on the front door at a position in response to the lock mechanism.

4. The front door according to claim 1, wherein the door extension portion is provided from a substantially lower part to a substantially center part of the front door in the up and down direction.

* * * * *